US006113387A

United States Patent [19]

Wilson et al.

[11] Patent Number: 6,113,387

[45] Date of Patent: Sep. 5, 2000

[54] METHOD AND APPARATUS FOR CONTROLLING KILN

[75] Inventors: Herb G. A. Wilson, Oakville, Canada; Jeffery Thompson, Atlanta, Ga.; Robert Perricone, New Tazewell; Michael Barkdoll, Knoxville, both of Tenn.

[73] Assignee: Global Stone Corporation, Ontario, Canada

[21] Appl. No.: 09/377,092

[22] Filed: Aug. 19, 1999

Related U.S. Application Data

[63] Continuation of application No. 08/911,490, Aug. 14, 1997, abandoned.

[51] Int. Cl.[7] ..... F27D 1/08

[52] U.S. Cl. ..... 432/99; 432/95; 432/96

[58] Field of Search ..... 432/36, 95, 96, 432/97, 98, 99, 101, 102; 431/89, 90, 12, 75, 80, 78

[56] References Cited

U.S. PATENT DOCUMENTS

| | | | |
|---|---|---|---|
| 3,584,850 | 6/1971 | Brandvold . | |
| 3,888,621 | 6/1975 | Williams . | |
| 4,002,421 | 1/1977 | Summer . | |
| 4,094,629 | 6/1978 | Greenawalt . | |
| 4,097,225 | 6/1978 | Rourke . | |
| 4,118,172 | 10/1978 | Noir et al. . | |
| 4,210,632 | 7/1980 | Rourke . | |
| 4,315,735 | 2/1982 | Fussl et al. . | |
| 4,372,784 | 2/1983 | Hess . | |
| 4,465,455 | 8/1984 | Meyer | 431/27 |
| 4,747,773 | 5/1988 | Predescu et al. . | |
| 5,460,517 | 10/1995 | Scheibenreif et al. | 432/95 |
| 5,486,107 | 1/1996 | Bonne | 431/121 |
| 5,816,792 | 10/1998 | Spencer | 431/90 |

OTHER PUBLICATIONS

Fischbach et al., "Computer Control of a Coke–Fired Vertical Lime Kiln", Siemens Rev, Feb. 1971, vol. 38, pp. 80–83.

*Primary Examiner*—Denise L. Ferensic
*Assistant Examiner*—Jiping Lu
*Attorney, Agent, or Firm*—Luedeka Neely & Graham PC

[57] ABSTRACT

A regenerative shaft kiln having at least two vertical shafts and a plurality of lances for introducing fuel into the kiln, with one or more sensor provided proximate a plurality of the lances, each of the sensors producing a first output signal having a magnitude and corresponding to a physical parameter of the kiln adjacent the sensor. Observation of the operating conditions of individual lances enables adjustments to the fuel feed via individual lances to avoid equipment damage and to improve kiln performance.

8 Claims, 13 Drawing Sheets

METHOD AND APPARATUS FOR CONTROLLING KILN

This application is a continuation of application Ser. No. 08/911,490 filed Aug. 14, 1997 abandoned.

FIELD OF THE INVENTION

This invention relates generally to kilns for firing aggregate materials. More particularly, this invention relates to a multiple vertical shaft regenerative kiln for calcining limestone and to a method for operating the kiln which enables improved control over the kiln.

BACKGROUND AND SUMMARY OF THE INVENTION

Lime, or quicklime, is the oxide of calcium, CaO, and is commonly obtained by calcining limestone. Limestone is calcined in two main types of kilns, vertical or shaft kilns, and horizontal, rotary kilns.

Shaft kilns are of two main varieties, single shaft and multiple shaft. In both, solid particulate matter (limestone or other mineral aggregate) is loaded into the kiln shaft or shafts from the the top of the kiln and slowly travel down the shaft. In a single shaft kiln, the flow of gas is counter-current to the travel of limestone. In a multiple shaft or so-called "regenerative" kiln a crossover duct is provided between lower portions of the shafts and not all of the shafts are active at the same time. Air travels downwardly through the active shaft and crosses to the other shaft and flows upwardly therethrough for preheating of the aggregate prior to activation of the shaft.

For example, in a double shaft kiln, only one shaft is active at a time. During the active phase fuel, such as powdered coal, is introduced into the shaft via lances and combustion gases are flowed downwardly through the shaft in the same direction as the travel of aggregate. The combustion gases pass through the crossover duct between the shafts and travel upwardly through the inactive shaft. After a period of time, the airflow is reversed and fuel is introduced into the other shaft. Thus, as used herein, the terminology "regenerative shaft kiln" shall be understood to refer to kilns of the type having at least two vertical shafts, wherein combustion air is flowed downwardly in shafts during their active phase, through a crossover between active and inactive shafts and upwardly through inactive shafts.

One challenge of regenerative or multiple shaft kilns is the initial or start-up phase of these kilns. Because these kilns are often configured to calcine several hundred tons of limestone per day and calcining requires a temperature of about 1750° F., it can often take several days to obtain operating conditions within the kiln. Once the kiln is properly started it can typically run for long periods of time without significant adjustment. However, getting to that point requires considerable adjustment and activity on the part of the operator with considerable loss in equipment from damage and loss of quality product from down-time and waste from poor operating conditions. Difficulty in starting the kiln is typically a function of the fuel type and grade, with the more expensive fuels being easier to work with. For example, kilns using exclusively natural gas are typically easier to start up, but gas is considerably more expensive than coal. Also, European coal which is typically lower in volatile content than most coals found in the United States is typically less troublesome than U.S. coals, but much more expensive.

Another difficulty resides in control over the temperature within the kiln. For example, if the limestone is not subjected to sufficient temperature for sufficient time, it will not be turned into lime. Also, if the temperature is too high (above about 1950° F.) the limestone will over burn and have lesser value. Still another relates to the introduction of fuel into the kiln. For example, it has been experienced that high cost lances used to introduce fuel into the kiln can be destroyed by overheating.

An attempt to overcome problems in kiln operation, particularly during start-up, has been to monitor the temperature at the cross-over, at the top of the kiln and along the height of the kiln using thermocouples embedded in the refractory material inside the kiln. This method has proved ineffective, as damage to components of the kiln, particularly fuel lances has been observed even when the measurements are within the desired range.

Accordingly it is an object of the present invention to provide an improved multiple shaft or regenerative kiln and a method for controlling such a kiln which avoids many of the disadvantages of conventional regenerative kilns.

An additional object of the invention is to provide a kiln of the character described and a method for operating such a kiln which facilitates operation of the kiln and avoids many of the problems associated with the use of particular fuels.

Another object of the present invention is to provide a kiln of the character described which enables monitoring of conditions adjacent fuel feed lances within the kiln.

A further object of the present invention is to provide a method for controlling conditions within the lime kiln in response to measured conditions within the kiln to avoid destruction of lances within the kiln.

Yet another object of the present invention is to provide an improved method for starting up a regenerative kiln.

Still another object of the present invention is to provide a kiln of the character described which is uncomplicated in configuration and economical.

A still further object is to provide a lance construction which is advantageous as compared to conventional lances.

Having regard to the foregoing and other objects, the present invention is directed to a regenerative shaft kiln. According to the invention, the kiln includes at least two vertical shafts. Each shaft of the kiln includes a pre-heating zone in communication with a source of aggregate for introducing aggregate into the kiln and a fuel introduction zone below the pre-heating zone.

A plurality of lances are provided within the fuel introduction zone in flow communication with a source of fuel for introducing fuel into the kiln. A combustion zone is provided below the fuel introduction zone, and a cooling zone is below the combustion zone. A crossover zone between the combustion zone and the cooling zone connects the shafts is in flow communication with the crossover zone of at least one other shaft.

A sensor is provided proximate each of a plurality of the lances, each of the sensors producing a first output signal having a magnitude and corresponding to a physical parameter of the kiln adjacent the sensor.

A significant aspect of the invention relates to the configuration and operation of lance systems which introduce fuel into the kiln via the kiln. This enables an operator to monitor the operating conditions of individual lances and to control the introduction of fuel into individual ones of the latices in response to the operating conditions.

For example, in a preferred embodiment, both the pressure within the lances and the temperature of the tip of each lance are monitored, with the operator instructed to watch for undesirable pressure and/or temperature increases which are indicative of undesirable plugging of the lance. In response to the operator becoming aware of high pressure and/or temperature readings for a given lance, the operator may take action to prevent damage to the expensive lances.

One response is to shut off the fuel to the indicated lance for the next active cycle (about 15 minutes) which action has been observed to alleviate the problem in many cases. Thus, the invention enables close observation over the operation and operating environment of the individual lances and enables the operator to take action and prevent equipment damage, which is expensive both in terms of equipment cost as well as in loss of production resulting from downtime and/or poor quality from inadequate process conditions.

In an alternative embodiment, a computer monitors the temperature and pressure measurements from each lance, displays those measurements and automatically shuts off or decreases fuel flow to the lance in response to temperature and pressure measurements that exceed predetermined criteria.

BRIEF DESCRIPTION OF THE DRAWINGS

The above and other features and advantages of the present invention will become further known from the following detailed description when considered in conjunction with the accompanying drawings in which.

DETAILED DESCRIPTION

Figure 1:
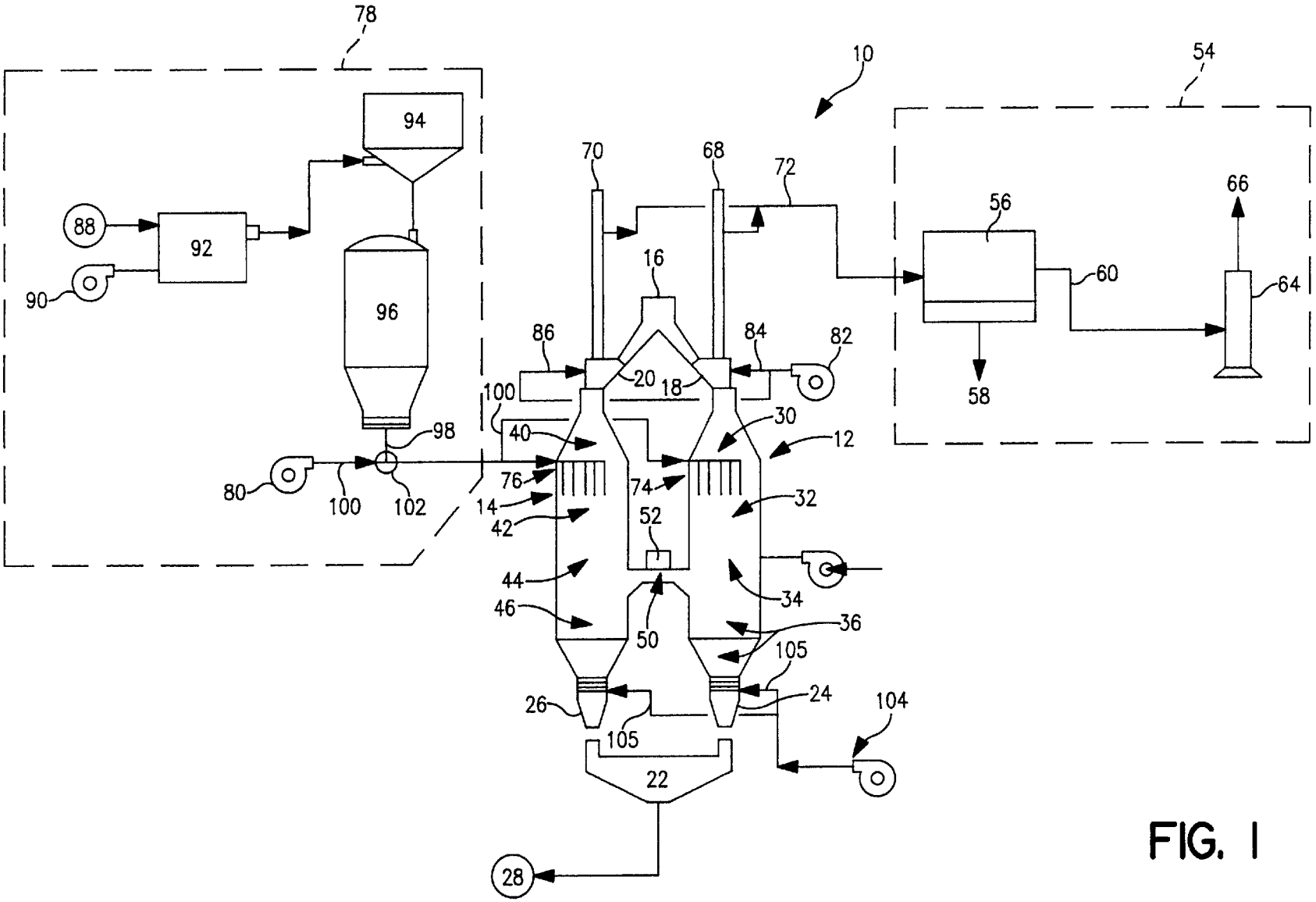
FIG. 1 is a schematic view of a kiln in accordance with the invention.

With initial reference to FIG. 1, there is shown a schematic diagram of a regenerative kiln system 10 provided in accordance with the invention. The conventional portion of the kiln is preferably provided by a twin shaft regenerative vertical kiln available under the trade name NS-70 CIM-REVERSY from Cimprogetti, S.P.A. of Bergamo, Italy, having a capacity of about 300 metric tons per day.

The kiln 10 includes a pair of preferably identical parallel, vertical steel shafts 12 and 14 lined with a refractory material, such as alumina, magnesia or fireclay bricks. Limestone or other mineral aggregate such as chalk, marble all containing in excess of 90% calcium carbonate is charged into the top of each shaft 12 and 14 from a hopper 16 or other supply source by way of inlets 18 and 20, respectively, and the limestone is calcined as it descends slowly to the bottom to each shaft where it is discharged into a collection hopper 22 via outlets 24 and 26 from which it may be collected and transferred to a storage silo as at 28, for example.

The limestone supply is preferably a minimum of 97% calcium carbonate and has been processed to be clear and free of all deterious matter such as clay, dust and having a minimum dimension of about 1 inch and a maximum dimension of about 6 inches, with a preferred dimension of about 2 inches by about 4 inches. The hopper 16 preferably includes suitable metering and distribution mechanisms for controlling the feed of material into the shafts 12 and 14.

The shaft 12 includes a preheating zone 30 adjacent the inlet 18, a fuel introduction zone 32 below the preheating zone 30, a combustion zone 34 below the zone 32, and a cooling zone 36 below the combustion zone 34 and in flow communication with the outlet 24. The shaft 14 likewise includes a preheating zone 40, fuel introduction zone 42, combustion zone 44, and cooling zone 46. An arched crossover duct 50 located between the combustion and cooling zones connects the shafts 12 and 14. A source of heat, such as an oil injection lance 52, is preferably provided within the crossover duct 50 for heating of the kiln during the start-up phase.

Figure 2:
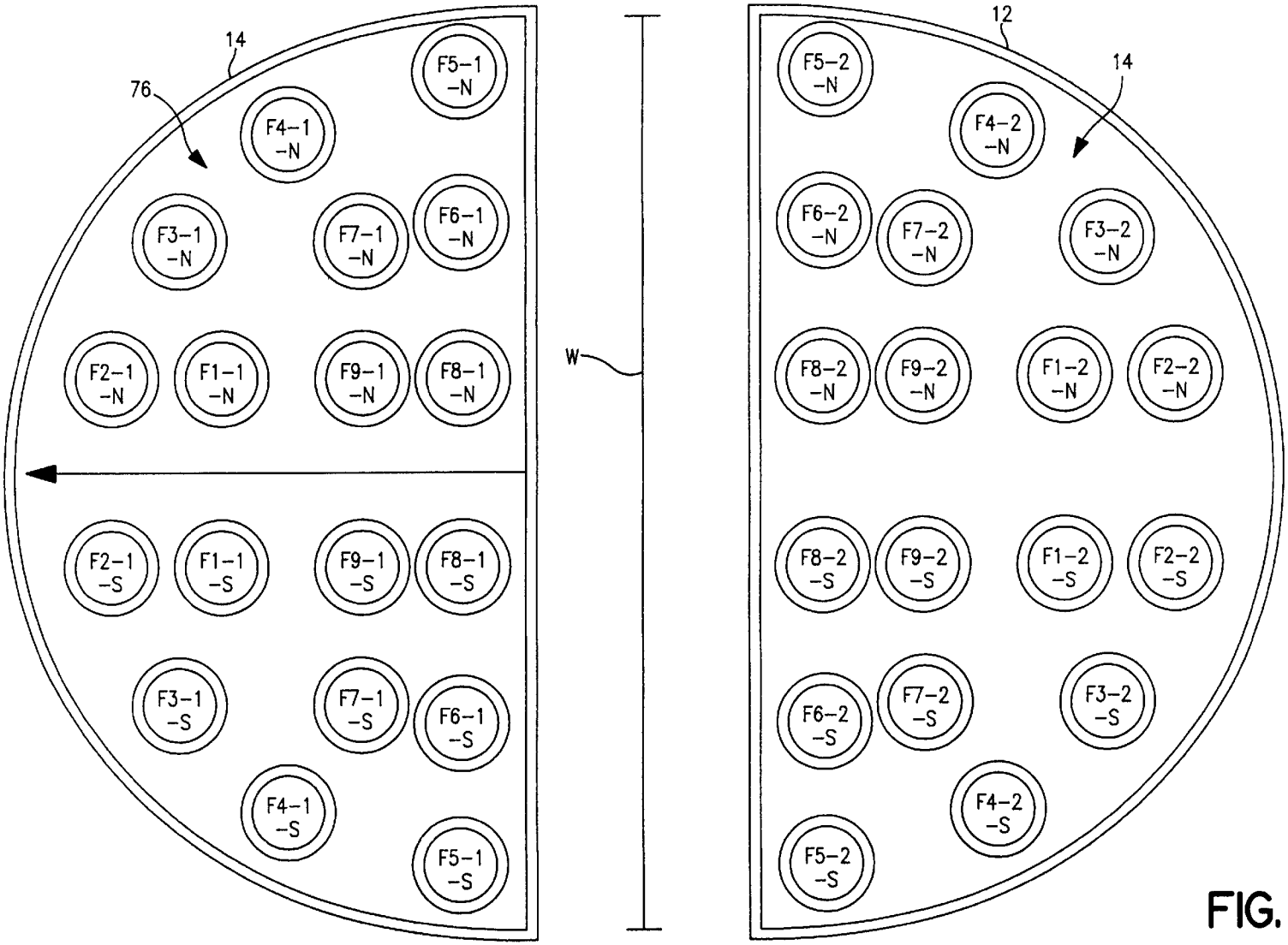
FIG. 2 is a top representational view of the D-shaped shafts of the kiln and the arrangements of lances in the kiln for delivering fuel.

For the purpose of an example, the shafts of the NS-70 CIM-REVERSY kiln have an overall height of about 80 feet, with the preheating zone having a height of about 21 feet, the fuel introduction zone a height of about 3 feet, the combustion zone a height of about 13 feet, and the cooling zone a height of about 17 feet. The width W of the d-shaped shafts within the refractory lining is also preferably about 13.8 feet across, with an inner radius R of about 6.9 feet (FIG.2).

During operation of the kiln 10, only one shaft is active at a time. The crossover duct 50 enables combustion gases generated in the active shaft to enter the other "inactive" shaft for upward passage through the limestone in the inactive shaft before exiting to a pollution control system 54 for treatment of kiln combustion gases and includes a baghouse 56 from which solids (i.e., lime dust, etc.) may be discharged as at 58 and gases discharged as at 60. The gases are vented via stack 64 to the atmosphere as at 66.

The kiln configuration provides an airflow that is advantageous to preheat the material in the inactive shaft prior to activation of that shaft and thus allows recuperation of heat and reduces fuel requirements. Outlets 68 and 70 associated with the shafts 12 and 14, respectively, are preferably routed to a common header 72 for collection of exhaust gases from the shafts 12 and 14 and transportion of the gases to the pollution control system 54.

Lance systems 74 and 76 discussed in more detail below, are provided within the fuel introduction zones 32 and 42 of the shafts 12 and 14, respectively, for injecting fuel from a fuel supply system 78 into the shafts during operation of the kiln. The fuel is preferably injected by air pressure in part supplied by a blower system 80. The air from the blower system 80 also enters the shafts via the lance systems 74 and 76 as explained below in connection with FIG. 8 and serves as a secondary source of air for combustion. Excess air is preferably introduced into the top of the shafts 12 and 14 via blower 82 and conduits 84 and 86 during injection to the fuel to provide the primary source of air for combustion.

The fuel is preferably pulverized coal or coke or a mixture of the two, such as high volatile bituminous coal found typically in the U.S. states of Tennessee, Kentucky, West Virginia, Pennsylvania, Wyoming, Colorado or petroleum coke produced as a byproduct of petroleum refining. However, a variety of other fuels may be used, such as natural gas, and heavy fuel oils. The fuel supply system 78 preferably includes a source of the fuel 88, air blower 90, mill 92 for pulverizing the fuel to a desired size, air classifier 94 and fuel storage bin 96. Conduit system 98 from the bin 96 and conduit system 100 from the blower 82 are in flow communication with one another, the lance systems 74 and 76 and a lance feed control system 102 for supplying and controlling fuel to the kiln, as will be described in more detail below in connection with FIG. 8.

It will be understood that the operation of the kiln begins with an initial start-up phase (Phase I) wherein aggregate is loaded into the kiln. The start-up phase typically lasts from about 24 to about 36 hours or more. Heat for the initial start-up is preferably provided by the oil injection lance 52. The start-up phase ends when the stone bed temperature is sufficient to provide ignition of the fuel injected via lances 74 and 76 and it is then preferred to remove the burner 52 from the kiln.

Production of lime begins with Phase I of the firing cycle. The exhaust gas ducting (68 or 70) above the active shaft is shut off during Phase I and fuel and combustion air are fed into the active shaft and the combustion gases generated in the active shaft flow through the crossover shaft 50 into the inactive shaft and exhausted to the pollution control system. Lime is discharged from the bottom of the active shaft into hopper 22 and cooling air is simultaneously injected into the cooling zone of each shaft via blower system 104 and associated conduits 105 to coot the product lime from a temperature of about 1650° F. to about 150° F., preferably about 180° F.

After Phase I are Phases II, III and IV, in seriatim. Introduction of limestone into the shafts occurs only in Phases II and IV; however lime discharge from the shafts is conducted only during Phases I and II. Phase I (and III) typically have a duration of from about 10 minutes to about 20 minutes, preferably from about 12 minutes to about 15 minutes.

In Phase II, fuel feed to all kiln lances is ceased and combustion air, and cooling air is vented to the atmosphere and limestone is fed into the previously active shaft. Phase II typically has a duration of from about 1 minute to about 2 minutes.

Phase III is identical to Phase I, however, the operations of shafts are reversed from Phase I, that is, the active shaft becomes the inactive shaft and vice-versa.

Phase IV is identical to Phase II, except limestone is charged into the opposite shaft charged in Phase II.

Lime discharged from the kiln may be transferred to a screening and crushing system and thereafter to storage and/or further processing.

As will be explained in more detail, a significant aspect of the invention relates to the configuration and operation of the lance systems 74 and 76, to the monitoring of certain operating conditions of individual lances of the lance systems and to control of the introduction of fuel into individual ones of the lances in response to the monitored conditions.

THE LANCE SYSTEMS

In a preferred embodiment, between about 16 and 20 lances, preferably about 18 lances are provided as part of each lance system 74 and 76 within each shaft 12 and 14 and positioned to substantially evenly distribute fuel by pulsed injection into the aggregate traveling down the shafts. The lances are preferably positioned in an array such as is shown in FIG. 2, with the spacing between adjacent ones of the lances preferably being from about 15 to about 24 inches apart, most preferably about 18 inches for the described shafts.

As will be seen, the lances are configured to enable monitoring of the temperatures at the tips of the lances and the pressure within each lance, it having been discovered that close observance of these parameters and appropriate action in response to the observance of undesirable temperature and or pressure can enable an operator to avoid damage to the lances as well as lost time and product associated with equipment damage. In addition, it will be understood that various other lance parameters may also be monitored to enable further improvements to the operation of the kiln. For example, the makeup of the gases adjacent the lance tip or other regions of the kiln as well as other parameters may be monitored and reacted to in order to provide improvements in kiln operation and product quality.

For ease of identification of the lances in connection with the computer monitoring system described subsequent hereto in connection with FIGS. 10–13, the lances in each shaft are preferably identified by a three-phase number such as F1-1-N, wherein F1 stands for fuel line 1, the next number (1) stands for shaft number (1 or 2) and the letter N stands for the North side of the shaft. However, it will be appreciated that other identification schemes may be used.

As can be seen from the numbering scheme of the lances depicted in FIG. 2, the kiln system preferably includes nine fuel lines, with each fuel line feeding two lances in each shaft. Thus, in a preferred embodiment the fuel lances in shaft 12 are numbered F-1-N, F1-1-S, F2-1-N, F2-1-S, F3-1-N, F3-1-S, F4-1-N, F4-1-S, F5-1-S, F5-1-N, F6-1-S, F6-1-N, F7-1-S, F8-1-N, F8-1-S, F9-1-N, F9-1-S and the fuel lances in shaft 14 are numbered F1-2-N, F1-2-S, F2-2-N, F2-2-S, F3-2-N, F3-2-S, F4-2-N, F4-2-S, F5-2-S, F5-2-N, F6-2-S, F6-2-N, F7-2-S, F8-2-N, F8-2-S, F9-2-N, F9-2-S.

Figure 3:
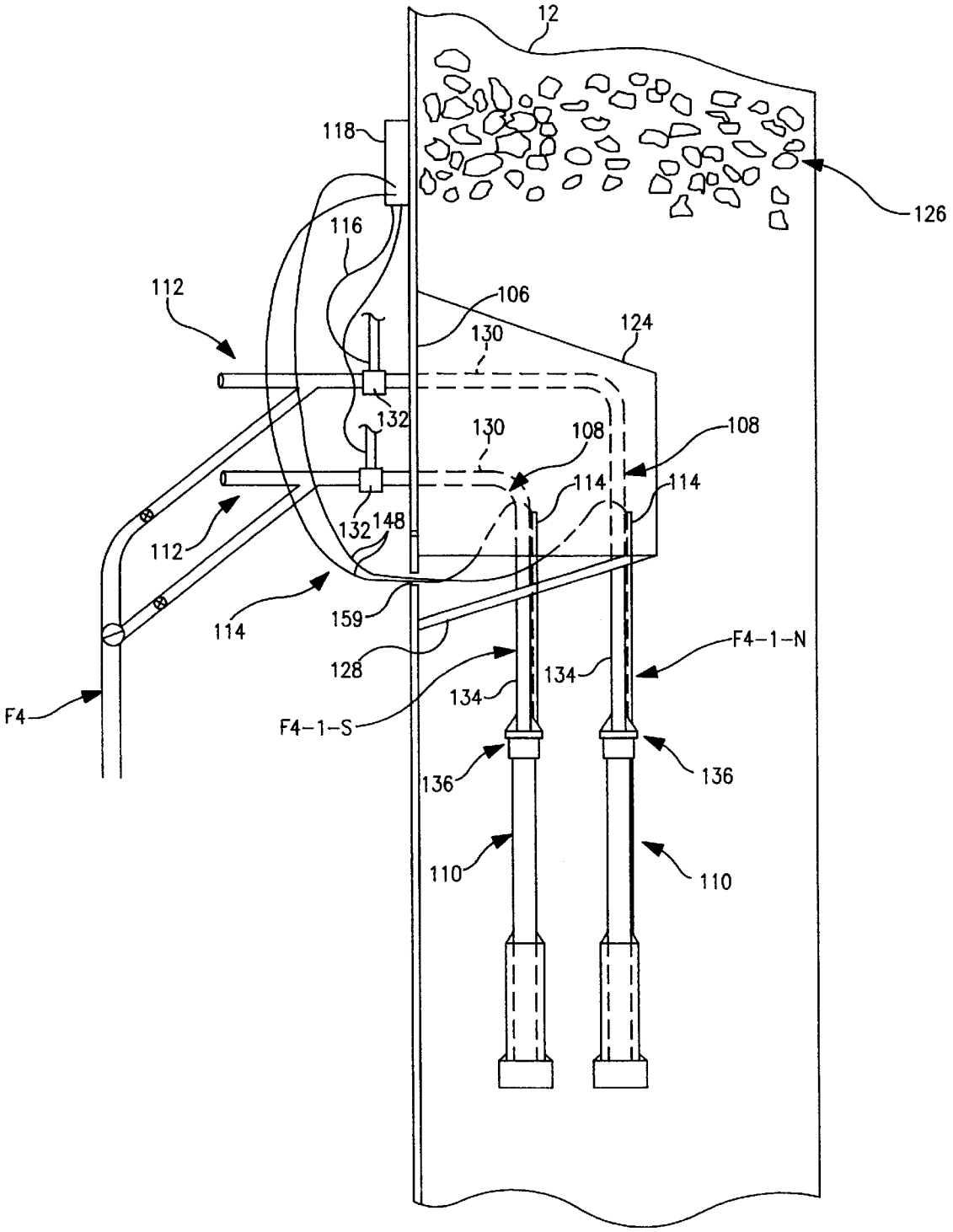
FIG. 3 is a side elevational view showing a pair of lances within the kiln.

With reference now to FIG. 3, there is shown a pair of the lances (F4-1-S and F4-1-N) fed by a fuel line F4 and positioned within the shaft 12 for supplying fuel into the kiln. As will be understood, fuel line F4 also feeds lances F4-2-S and F4-2-N in the other shaft. The routing of the fuel lines F1–F9 is described with more particularly below in connection with FIG. 8.

To facilitate installation of the lances and subsequent access to the lances for maintenance and the like, an access door 106 is preferably provided in the wall of the shaft 12. Each lance is substantially identical and includes an upper section 108, a lower section 110 and a lance feed assembly 112 (FIGS. 4–7).

Figure 9:
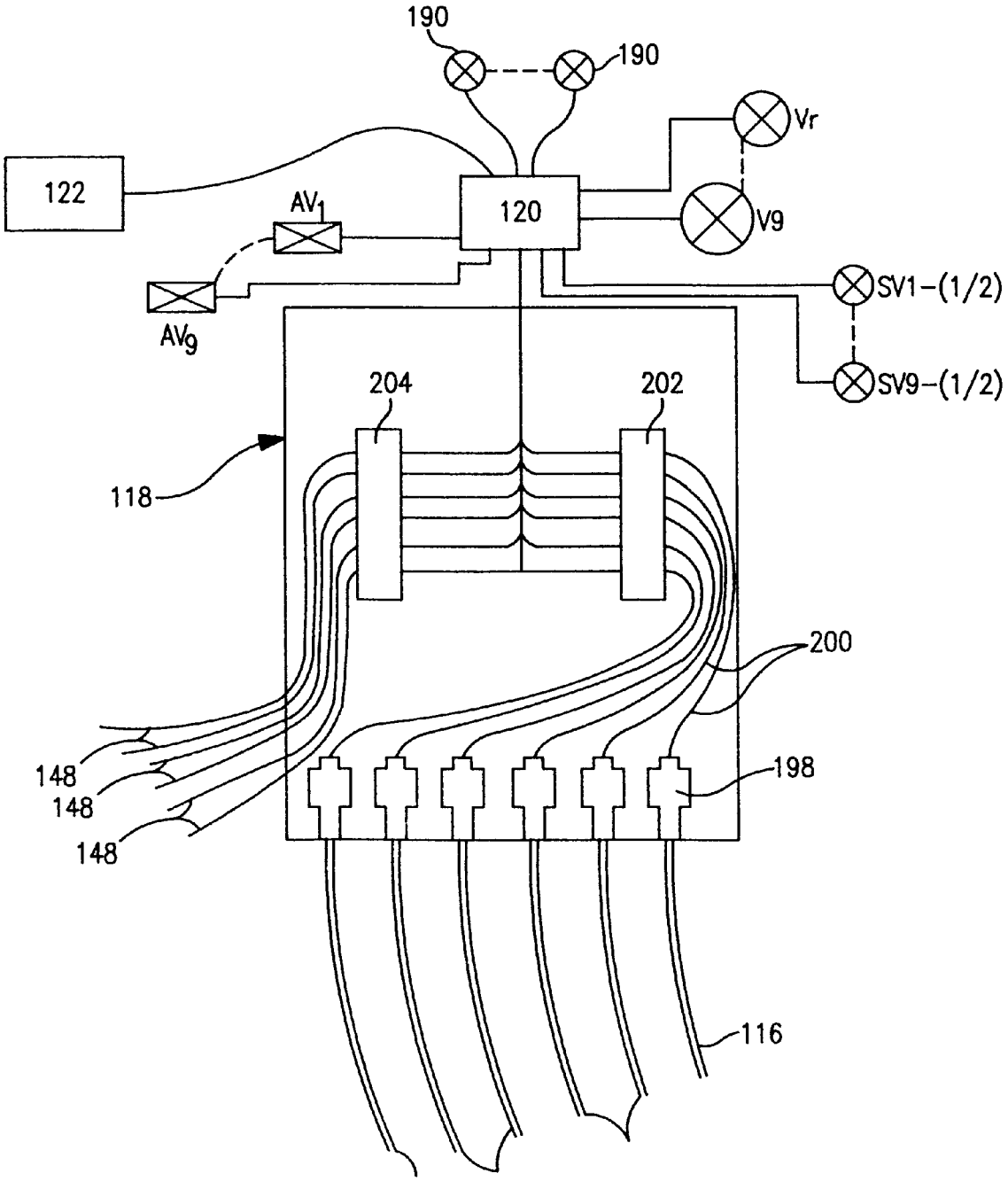
FIG. 9 is a detailed view of a pressure/temperature signal processing system in accordance with the invention.

Each lance is likewise preferably equipped with a temperature sensor assembly 114 and a pressure sensor assembly 116 (FIG. 7) which are routed via a connector assembly 118, the output signals of which are routed to a process logic controller 120 operatively associated with a computer control system 122 (FIG. 9).

An awning-shaped shield or deflector 124 is preferably provided above the lances to shield the lances from damage from the limestone 126 traveling down the shaft. The shield is preferably made of heavy gauge, carbon steel mounted as by bolting or welding to the interior of the shaft and having supports 128 for additional strength.

The upper section 108 connects the lance feed assembly 112 to the lower section 110 for flow communication of air and fuel therethrough and is preferably provided by a length of conduit to provide a horizontal section 130 which is connected by coupling 132 to the lance feed assembly 112, and a vertical section 134 which is connected by flange 136 to the lower section 110. The upper section 108 is preferably provided by a length schedule 80 carbon steel conduit.

Figure 4:
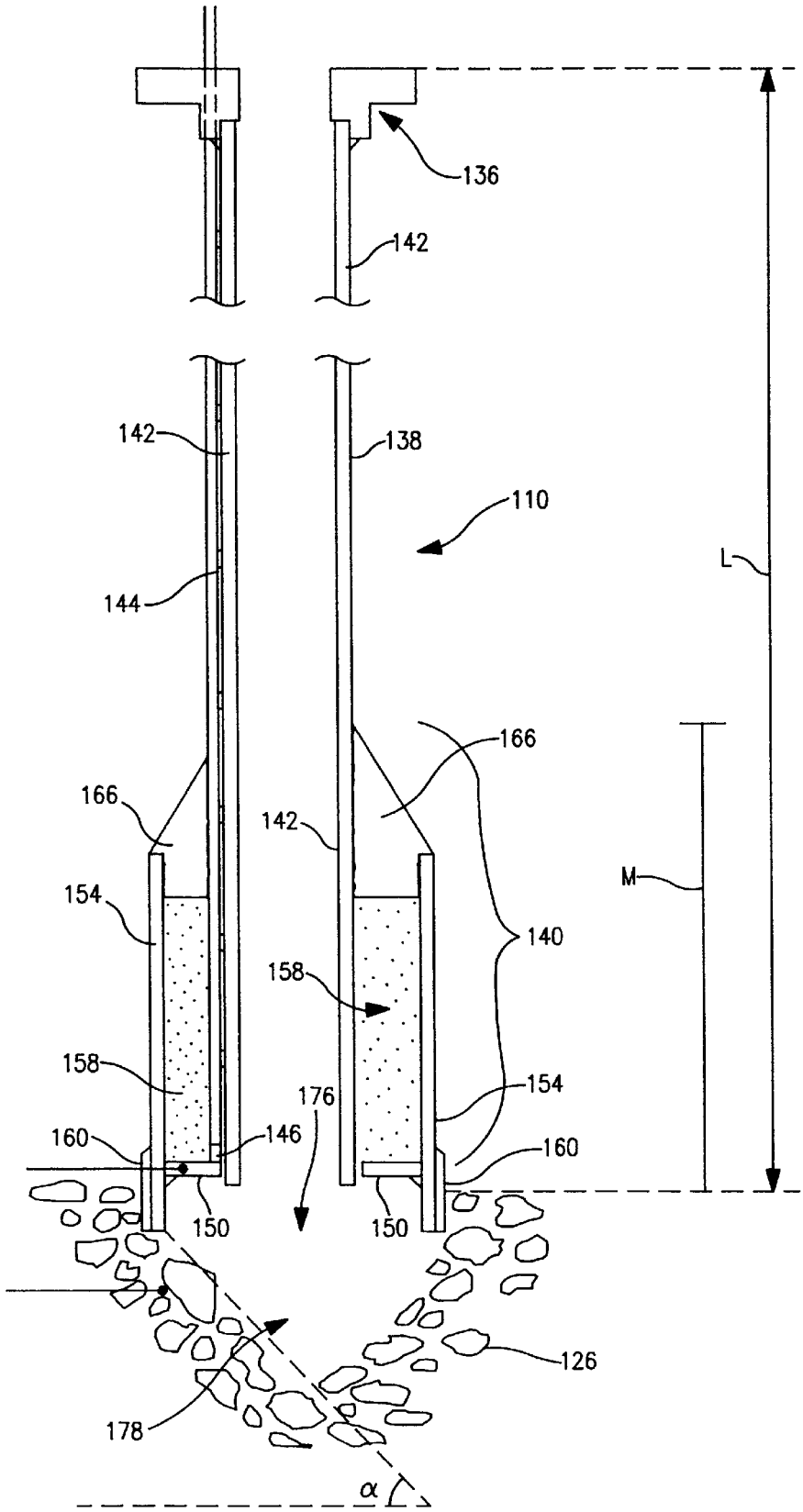
FIG. 4 is a lance having upper and lower sections and provided with a sensor in accordance with the invention.
Figure 5:
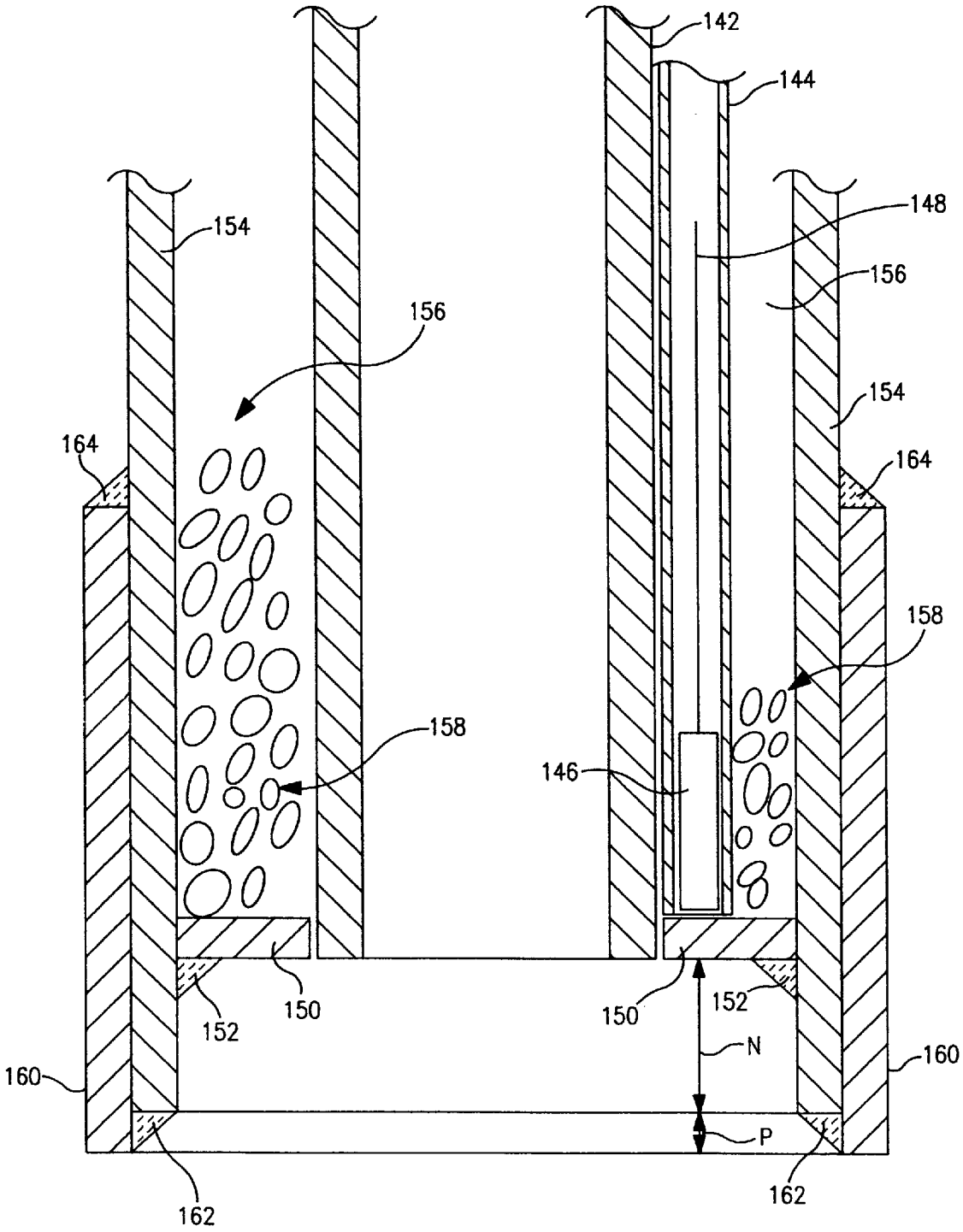
FIG. 5 is a close-up cross-sectional view of a lower portion of the lower section of the lance of FIG. 4.
Figure 6:
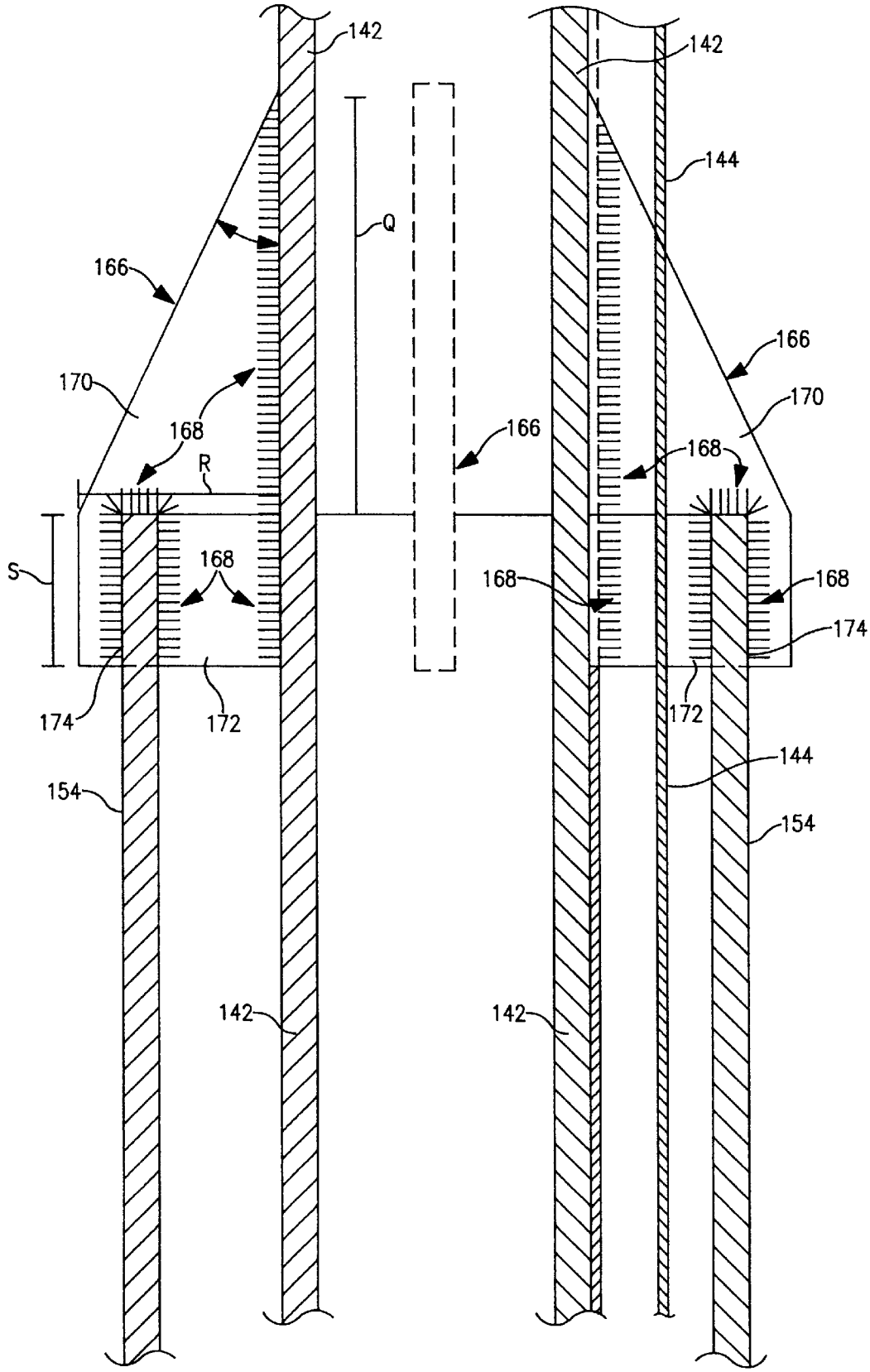
FIG. 6 is a close-up cross-sectional view of an upper portion of the lower section of the lance of FIG. 4.

With reference to FIGS. 4–6, the lower section 10 preferably has a length L of from about 5 to about 15 feet, most preferably about 10 feet, with upper portion 138 thereof having a length of about 7 feet and lower portion 140 having a length M of about 3 feet. The lower section 10 is preferably provided by a 10 foot length of stainless steel tubing 142 having an outer diameter of about 2.22 inches, an inner diameter of about 1.72 inches and referred to generally in the trade as "HL" S.S. tubing.

With reference to FIG. 5, the lower portion 140 includes a small-bore tube 144 attached to the tubing 142, preferably by welding as by applying a 2 inch weld every foot, for receiving a temperature sensor 146 and associated leads or wiring 148. The tube 144 is preferably stainless steel tubing having an inner diameter of about ⅜ inch, an outer diameter of about ⅝ inch and an overall length of about 13 feet such that the tube 144 extends above the bend provided in the upper section 108 of the lance and is protected from the migrating limestone by the awning 124 (FIG. 3). The bottom end of the tube 144 terminates against a steel closing plate 150 provided adjacent the bottom end of the tube 142 and secured as by weld 152 to the bottom of a jacketing pipe 154 which surrounds the lower portion of the tubing 142 to provide an annular area 156 which is preferably filled with a suitable refractory material 158, such as a low thermal conductivity, castable refractory.

The thermocouple 146 is preferably a standard "K" type thermocouple suitable for use in the temperature range of from about 32° F. to about 2250° F. may be used. The thermocouple is preferably inserted into the tube 144 until it contacts the plate 150 to avoid an air gap therebetween which might dampen the thermocouple response. The thermocouple leads 148 preferably exits the kiln shafts via a sealed gland 159 located below the access door 106 and thereafter to the process logic controller 118 (FIG. 3).

The jacketing pipe 154 preferably extends beyond the end of the tubing 142 a distance N of from about ½ to about 2 inches, preferably about 1 inch and is jacketed by another jacketing pipe 160 secured to the lower end of the pipe 154 as by weld 162 and at its upper end by weld 164, the welds preferably being full 309 type welds. The pipe 160 preferably extends beyond the end of the pipe 154 by a distance P of from about ¼ to about ½ inches, preferably about ¼ inch.

A suitable material for the tube 144 is ¼ inch schedule 40 310 SS pipe; the closing plate 150 may be provided by a ¼ inch thick 310 SS donut shaped plate having an inner diameter of about 2.25 inches and an outer diameter of 4 inches; the pipe 154 by a three foot long section of ¼ inch Schedule 40 310 S.S. pipe and the pipe 160 by a 4 inch long section of ¼ inch 310 SS bar rolled to a 4½ inch I.D.

With reference to FIG. 6, a plurality of gussets 166 may be attached as by welds 168 to the tube 142 and the pipe 154 for further rigidity. Preferably about four of the gussets are evenly spaced apart from one another. Each gusset 166 is preferably of one piece and includes an upper triangular region 170 having a height Q of about 2 and ½ inches and a base R of about 1 and ⅜ inches, and a lower rectangular region 172 having a height S of about 1 inch and including a slit 174 defined thereon to receive the upper end of the pipe 154. A suitable material for the gussets is ¼ inch thick 310 S.S. plate material sized to the above dimensions.

The jacket pipes 154 and 160 serve to increase the diameter of the lower end of the lance and thus provides an enlarged zone 176 into which the fuel may expand as it leaves the lower end of the lance tubing 142. Without the jacket pipes, the ratio of the outer diameter of the lance to the inner diameter of the lance is merely the ratio of the outer diameter of the tubing 142 (e.g. 2.22 inches) to its inner diameter (e.g. 1.72 inches), that is about 1.3. The thickness of the jacket pipes is selected to increase the ratio of the outer diameter to the inner diameter to from at least about 2 to about 3, and preferably about 2.6, to provide structure to deflect the mineral aggregate away from the lower end of the lance without changing the lance flow volume. In this regard, it has been discovered that the construction of the lower end of the lance in accordance with the invention also serves to prevent aggregate material (i.e., the limestone) from migrating into the area below the lance and thus provides a void space 178 below the lance which enables fuel and air from the lance to diffuse more readily into the stone 126 before it ignites. For the described lance, it has been observed that the limestone below the lance typically has an angle of repose $\alpha$ of about 42°.

Figure 7:
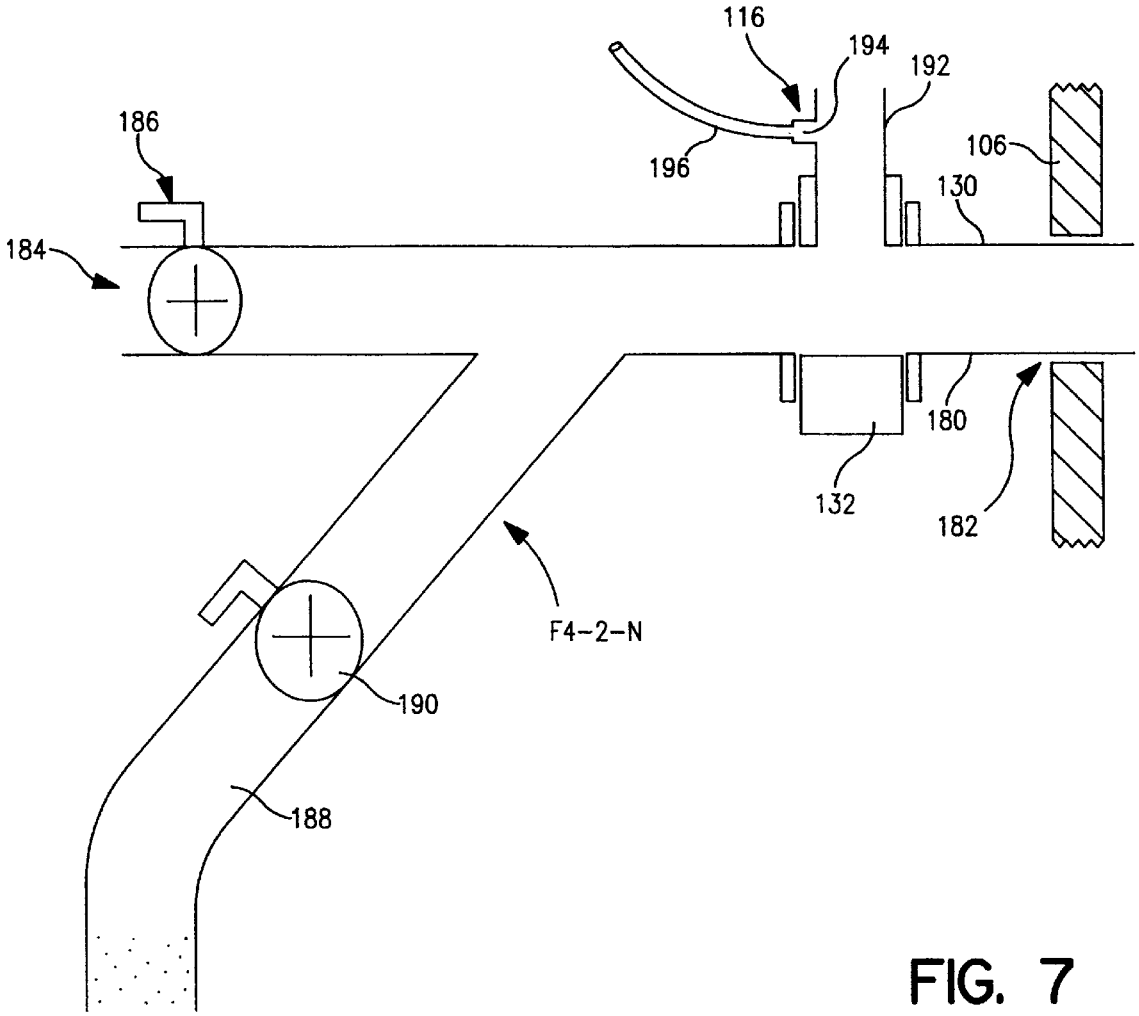
FIG. 7 is an enlarged detail view of a lance feed assembly in accordance with the invention.

FIG. 7 is a detailed view of one of the lance feed assemblies 112 for introducing air and fuel into the lances and for obtaining pressure readings within the lance system. As can be seen, the assembly 112 includes a main conduit 180, one end of which is joined with section 130 of the lance via coupling 132 for injecting air and fuel into the kiln. Section 132 exits the kiln through opening 182 in the door 106. Open end 184 of the conduit 180 is selectively accessible via valve assembly 186 for insertion of cleaning devices and the like in the event the lance becomes plugged and requires mechanic cleaning.

Fuel and its associated transport air preferably enters the main conduit 180 via fuel conduit 188 having a valve 190. The valve 190 is preferably a hand operated 1½" globe valve. In an alternative embodiment, each valve 190 is preferably an electro-mechanical valve which may be opened or closed either totally or incrementally in response to a signal generated by the computer 122.

Cooling air is preferably introduced into the lance via air conduit 192 which enters the conduit 180 at the coupling 132. The conduit 192 is in flow communication with the blower system 80 and conduit system 100 and associated control equipment or introducing cooling air into the lances as desired. An opening 194 is preferably provided in each conduit 192 for installation of the pressure sensor assembly 116, which is preferably provided by a length of tubing 196 connected between the opening 194 and an associated pressure transducer 198 located within the connector assembly 118 (FIG. 9). The tubing 196 is preferably ¼" copper tubing. The transducer 198 preferably has a range of from about 0 to about 1000 millibars.

Figure 8:
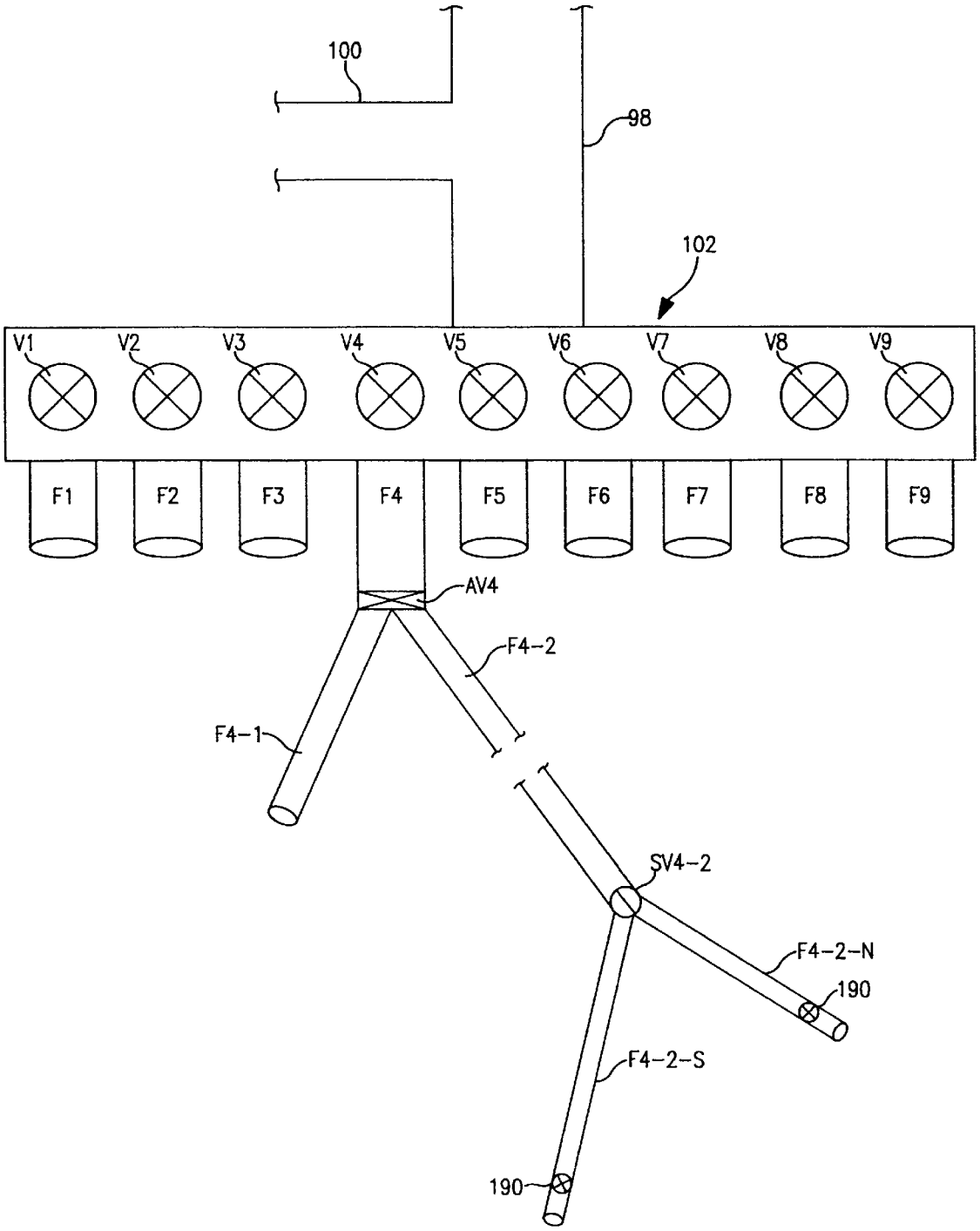
FIG. 8 is a schematic diagram of a fuel delivery system suitable for use in the invention.

With reference to FIG. 8, the lance feed control system 102 preferably includes a plurality of valves V1, V2, V3, V4, V5, V6, V7, V8 and V9 operatively associated with the fuel feed lines F1–F9, respectively, for controlling the flow of fuel into the fuel lines, it being noted that additional air enters the system 102 via the conduit 100 and fuel and its transport air enter the system 102 via the conduit 98. The valves V1–V9 are preferably rotary valves having an infinitely variable controller which automatically opens and closes the valves in accordance with predetermined criteria (i.e. open for 15 minutes, closed for 2 minutes, open for 15 minutes, etc.). In the alternative, the automatic sequence of the valves V1–V9 may be overridden in response to a signal from the computer 122.

Fuel line F4 is shown in greater detail for the purpose of an example. As can be seen, fuel line F4 splits into line F4-1 and F4-2, wherein F4-1 feeds two lances in one shaft (12) and F4-2 feeds two lances in the other shaft (14). In this regard, a solenoid actuated valve AV-4 is provided at the junction where F4 splits into F4-1 and F4-2, it being understood that similar valves are provided for the other fuel lines. As will be appreciated, the valve AV-4 flip-flops between feeding fuel to F4-1 and F4-2 depending upon which one is active at a given time, it being understood that F4-1 is active when shaft 12 is active and F4-2 being active when shaft 14 is active. In an alternative embodiment, each valve AV1–AV9 is preferably an electromechanical valve which may be opened or closed either totally or incrementally in response to a signal generated by the computer 122.

A mechanical splitter valve SV4-2 is provided on F4-2 at the junction where F4-2 splits into F4-2-N and F4-2-S, it being understood that a similar valve SV4-1 is provided on F4-1, with similarly identified valves provided for the remaining fuel lines, e.g., SV1-1, SV1-2, SV2-1, SV2-2, etc. The splitter valves are operable to divide the fuel flow to enable the operator to divide the fuel flow between the individual lines as desired, for example to account for differences in the lengths of the lines, the resistance to flow caused by bends and the like which create different pressure drops in the lines. In an alternative embodiment, each valve SV1–SV9 is preferably an electromechanical valve which may be manipulated in response to a signal generated by the computer 122. The valves 190 are preferably provided on each fuel line downstream of the splitter valve.

Turning to FIG. 9, the connector assembly 118 includes the pressure transducers 198 and a lead 200 electrically connecting each transducer 198 to a connector strip 202. The transducers convert the pressure into a low millivolt signal that is routed via the leads 200 and connector strip 202 to the process logic controller 120. The process logic controller 120 converts the signal to an output signal which is routed to the computer 122 for display on a computer monitor.

The connector assembly 118 also preferably includes a connector strip 204 or routing to the process logic controller 120 for conversion of the low millivolt electrical output of the thermocouple to numeric temperature or display on a computer monitor.

Figure 10:
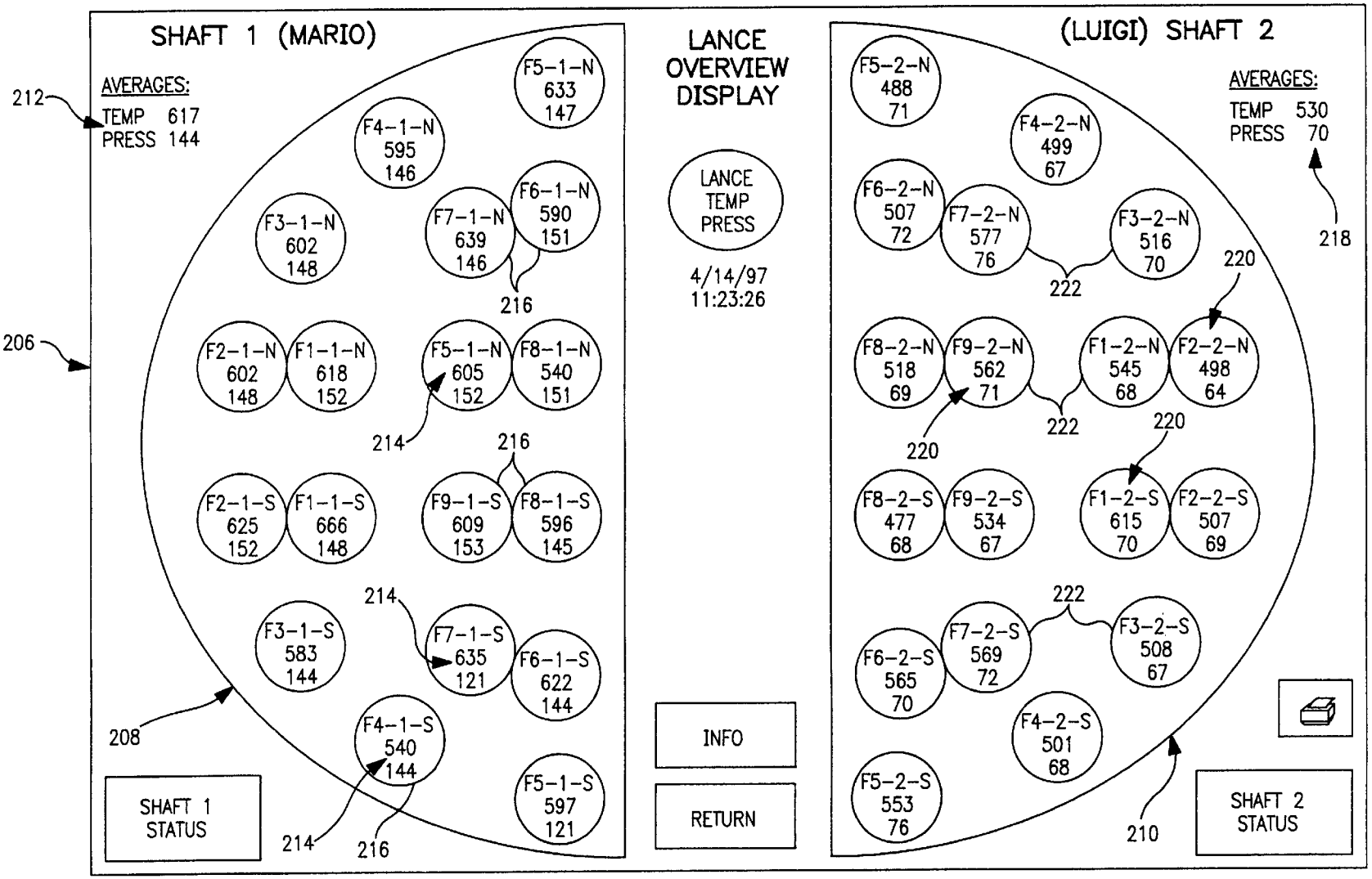
FIG. 10 is a computer screen display provided in accordance with the invention for controlling the supply of fuel to lances.

The interface display between the process logic controller 120 and an operator of the kiln is preferably provided using the computer system 122 operating human-machine interface software available under the trade name In Touch from Wonderwares Corporation of Irvine, Calif. which displays information on a standard computer monitor. FIG. 10 shows a preferred embodiment of one display format for information in which the screen display 206 provides a shaft representation 208 of the shaft 12 and a shaft representation 210 of the shaft 14. At this point, shaft 12 is active and shaft 14 is inactive.

The representation 208 preferably includes display of the averages of the temperature and pressure values obtained by way of the thermocouples and pressure transducer systems for each lance in a shaft, as by display indicia 212. In addition, temperature and pressure information for each lance in the shaft 12 is provided by display indicia 214 which preferably includes a representation of the shaft in the layout described in connection with FIG. 2, wherein each lance is represented by a circle 216. Within each circle 216 a three-tiered display format is preferably provided which includes the lance identification number, the lance temperature, preferably in degrees Celsius, and the lance pressure, preferably in millibars. Thus, for lance F4-1-S which for the purpose of this example has a temperature of 540° C. and a pressure of 144 millibars, the display circle 216 associated therewith preferably has therein the following information for observation by the operator:

F4-1-S

540

144

The information can be provided as desired by the operator for various periods of time. For example, the operator can select the length of time over which the average indicated by the indicia 212 is taken, e.g., 1 minute, 5 minutes, etc., and the information indicated by the indicia 214 may be similarly configured. For example, the indicia 214 may represent real time readings for each lance or the average for each lance for a specified period of time, e.g., 1 minute, 5 minutes, etc.

As will be noted, the temperature and pressure readings for the lances as shown by indicia 218 and indicia 220 in circles 222 for the inactive shaft are significantly lower.

To alert the operator of progressively increasing temperature or pressure of a lance, it is preferred that the progressively increasing temperature and pressure readings be displayed in a flashing format and then in a color-coded format once the readings exceed predetermined thresholds. For example, should the logic controller identify that the temperature is increasing at a rate above a predetermined threshold, for example, 25° C. per minute or if an increasing temperature is observed over a predetermined interval, such as a continuously increasing temperature for 30 minutes, the progressively increasing reading will be displayed as a flashing number. Likewise, if the pressure reading increases above a threshold value or rate, for example 150 millibars, the display of the numerical representation will be in a different color and or provided as a flashing display for notice by the operator. In addition, the computer may also be programed to generate a signal to sound an audible alarm or to generate signals that are sent to control equipment, i.e., to open or shut or otherwise adjust one or more of the valves to obtain a desired effect.

Figure 11:
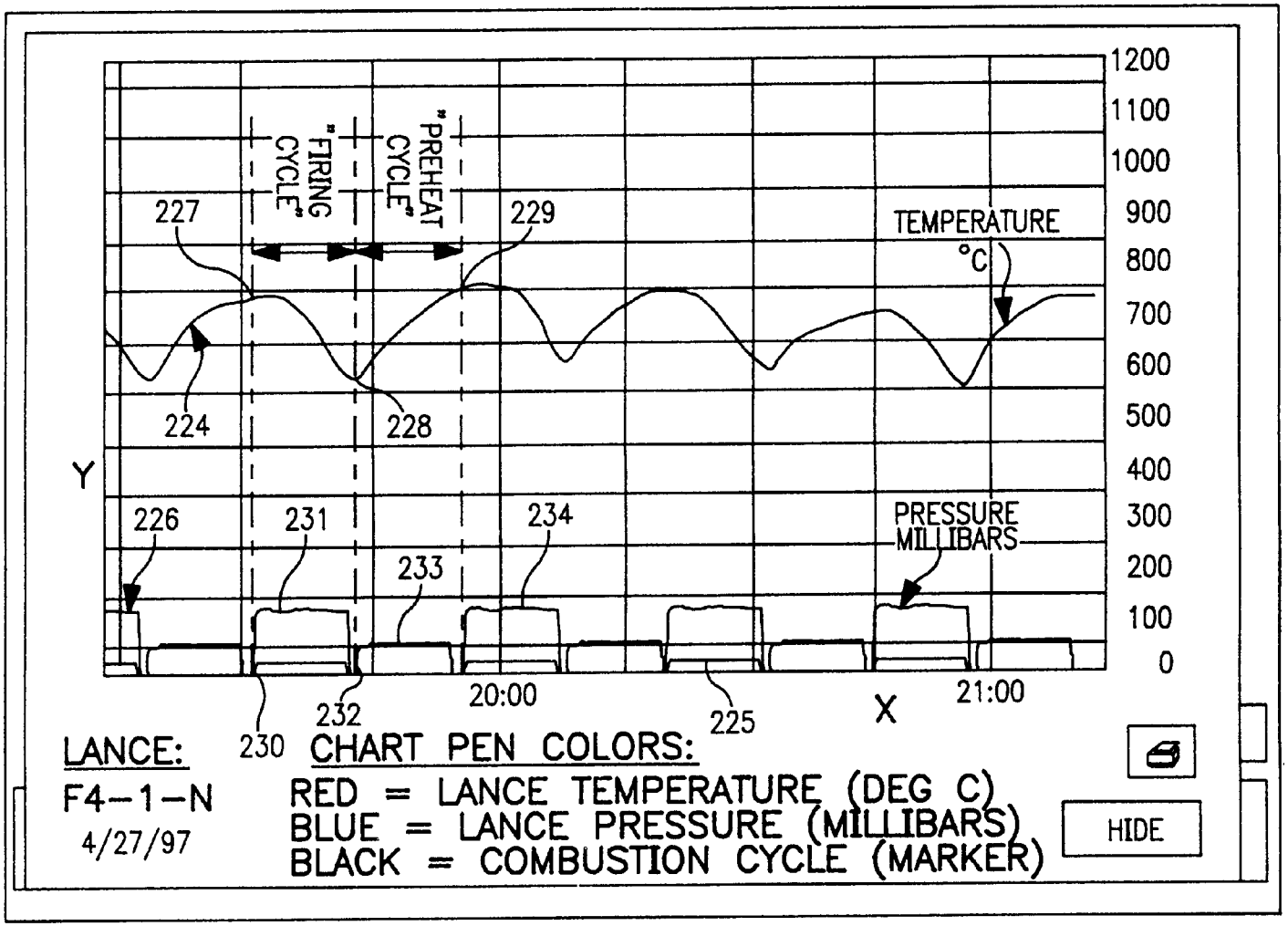
FIG. 11 is a computer screen display showing lance temperature and pressure versus time as monitored in accordance with the invention showing lance readings within the desired range.

In addition to the screen display 216, various other formats may be provided. For example, FIG. 11 is plot of temperature and pressure for an individual lance versus time that is displayed, preferably in response to user input. That is, the Y axis is scaled for reading of millibars and temperature and the X axis for time. In this plot, the curve 224 represents the temperature readings and the line 226 represents the pressure readings. The combustion cycle is represented by plot 225 for ease of identification of the beginning and end of the combustion or active cycle.

FIG. 11 is representative of a properly operating lance, as the temperature and pressure are both in the desired range. That is, for the described kiln operating under conditions selected to provide a rate of production of about 175 metric tons/day, the lance temperature is preferably from about 800° C. to about 500° C. in the active phase and from about 500° C. to about 800° C. in the inactive phase, and the pressure is from about 100 millibars to about 200 millibars in the active phase and from about 30 millibars to about 75 millibars in the inactive phase. As will be appreciated, these conditions will generally be increased for higher production rates and decreased for lower rates.

With further reference to FIG. 11, it has been observed that the lance temperature typically decreases by an amount of from about 100 to about 200° C. during the firing cycle when coal is injected through the lance, as shown by the curve 224 between points 227 and 228. This is believed to result from the cooling effect of the passage of the relatively cool fuel (typically from about 50° C. to about 70° C.) during injection. Then, during the inactive phase when fuel is not injected (between points 228 and 229) the lance temperature increases.

Likewise, the lance pressure as represented by curve 226 sharply increases at the beginning of the injection of fuel as shown at point 230, levels off to a substantially constant pressure throughout the injection or active phase 231 and sharply decreases back to 0 from about 150 millibars at the end of the active cycle as shown at point 232. The pressure then rises to a lower pressure during the inactive phase 233 between points 232 and 234.

Figure 12:
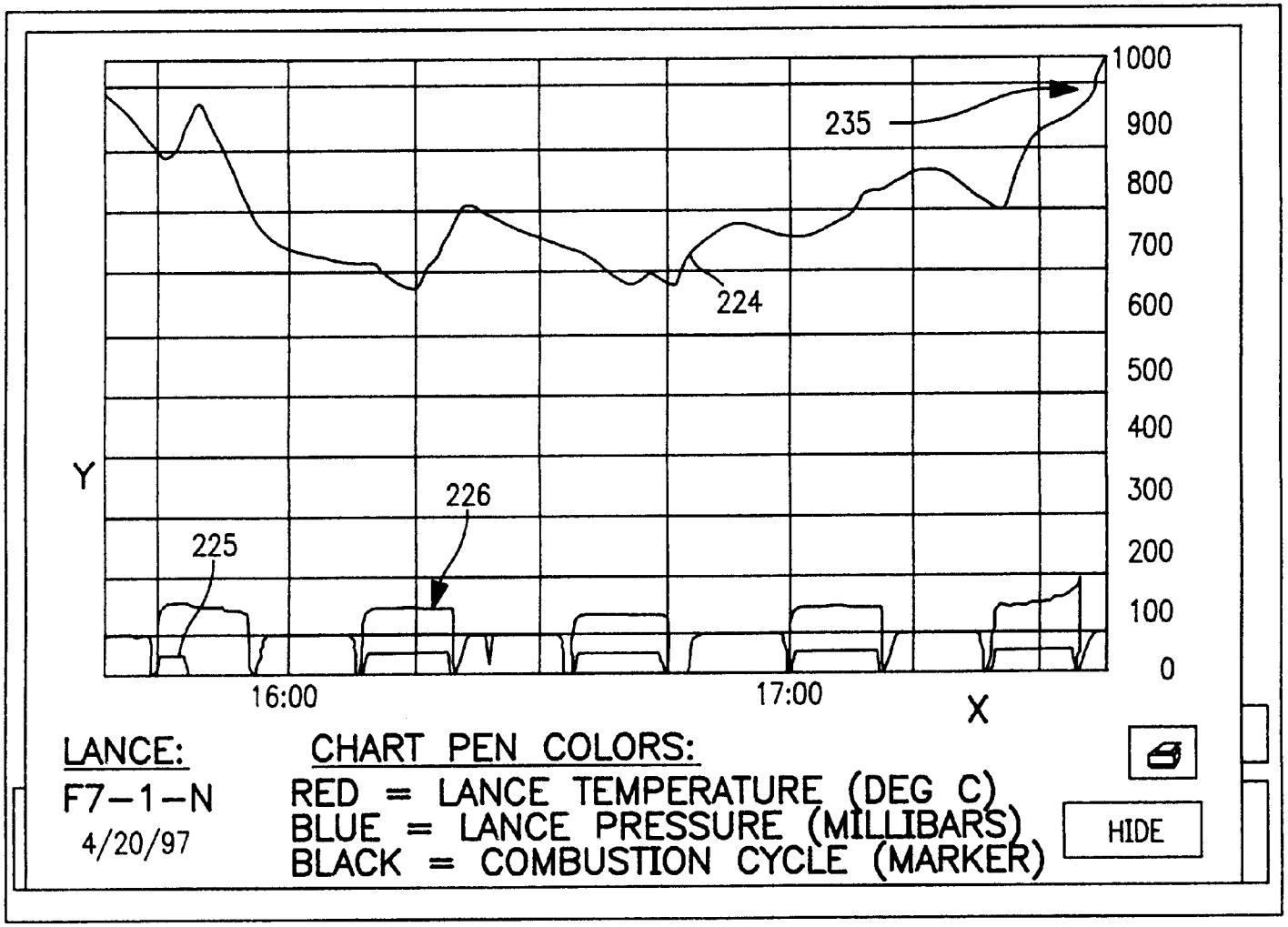
FIG. 12 is another computer display as in FIG. 11 but showing a lance having temperature above the desired range.

FIG. 12 is an example of a plot such as shown in FIG. 11, except the temperature of the lance has exceeded the desired range, as at 235, while the pressure has remained within the desired range. It has been experienced that a plot such as shown in FIG. 12 is typically symptomatic of localized heating at the lance tip which leads to destruction of the lances.

In response to an undesirable temperature or pressure or both for one or more lances, the operator may take various courses of action in attempt to correct the problem. Likewise, it will be understood that computer logic may also be used to evaluate the readings and activate kiln control equipment, i.e., valves, in the same manner.

It has been observed that manifestation of a problem as shown by the plot of FIG. 12 may be effectively taken care of in many instances by decreasing or even shutting off the fuel supply to the affected lance during the subsequent cycle. To accomplish this, an operator may reduce the flow through or shut off the actuating valve and/or other valves associated with the affected lance to reduce or even shut off the supply of fuel through that kiln for a desired period of time, typically ranging from about 1 to 2 cycles, with each cycle being from about 10 to about 20 minutes.

It has been observed that rapid escalation of lance temperatures such as shown by the plot of FIG. 12 is indicative of a heat distribution problem which, if left uncorrected, will damage the metal of the lance tips. For example, and without being bound by theory, it is believed that one cause of localized overheating of a particular lance or lances is caused by differential movement of the stone bed wherein the vertical column of stone within the kiln shaft does not move equally in cross-section while the shaft is firing. It has been observed that the temperature of the affected lances may be returned to normal by stopping the fuel supply to the affected lances for one or more firing cycles.

To accomplish this, the operator shuts off the fuel to the affected lances for a cycle and then resumes the supply of fuel during the subsequent cycle. If the heating problem reoccurs the operator may repeat the shut off procedure until the heating problem ceases.

It has been observed that if the heating problem does not cease after numerous cycles (e.g. after about 40 or more), there may be a problem in the shaft commonly referred to as "hanging" characterized by fusing of stones onto the shaft wall or fusing of numerous stones into one or more large blocks, both of which tend to interfere with movement of stone in the shaft. It has been observed that this problem requires shutting off fuel to all lances for several hours until the problem clears and/or physically removing the fused stone from the shaft.

Accordingly, the operator may manipulate one or more of the valves as outlined above to overcome the problem with the lance. In the alternative, it will be understood that the computer 122 may compare the measurements of the pressure and temperature with predetermined criteria and generate one or more signals to open, shut or otherwise adjust one or more of the system valves in response to comparison of the measured information with predetermined logic criteria.

In a preferred embodiment, for example, the lance monitoring system preferably includes deviation set points for maximum allowable lance temperature and for lance line pressures which exceed a value in excess of all lances in that shaft. That is, if the average pressure in all lances is 150 millibars during firing, an alarm will preferably be set to advise of individual lance pressures which exceed the average by about 20 or more millibars (e.g., for pressures above about 170 millibars). Thus, as in the case of excessive temperatures as described previously, the lance operator will shut off fuel to the affected lance or lances in the manner described previously until the problem is eliminated.

Figure 13:
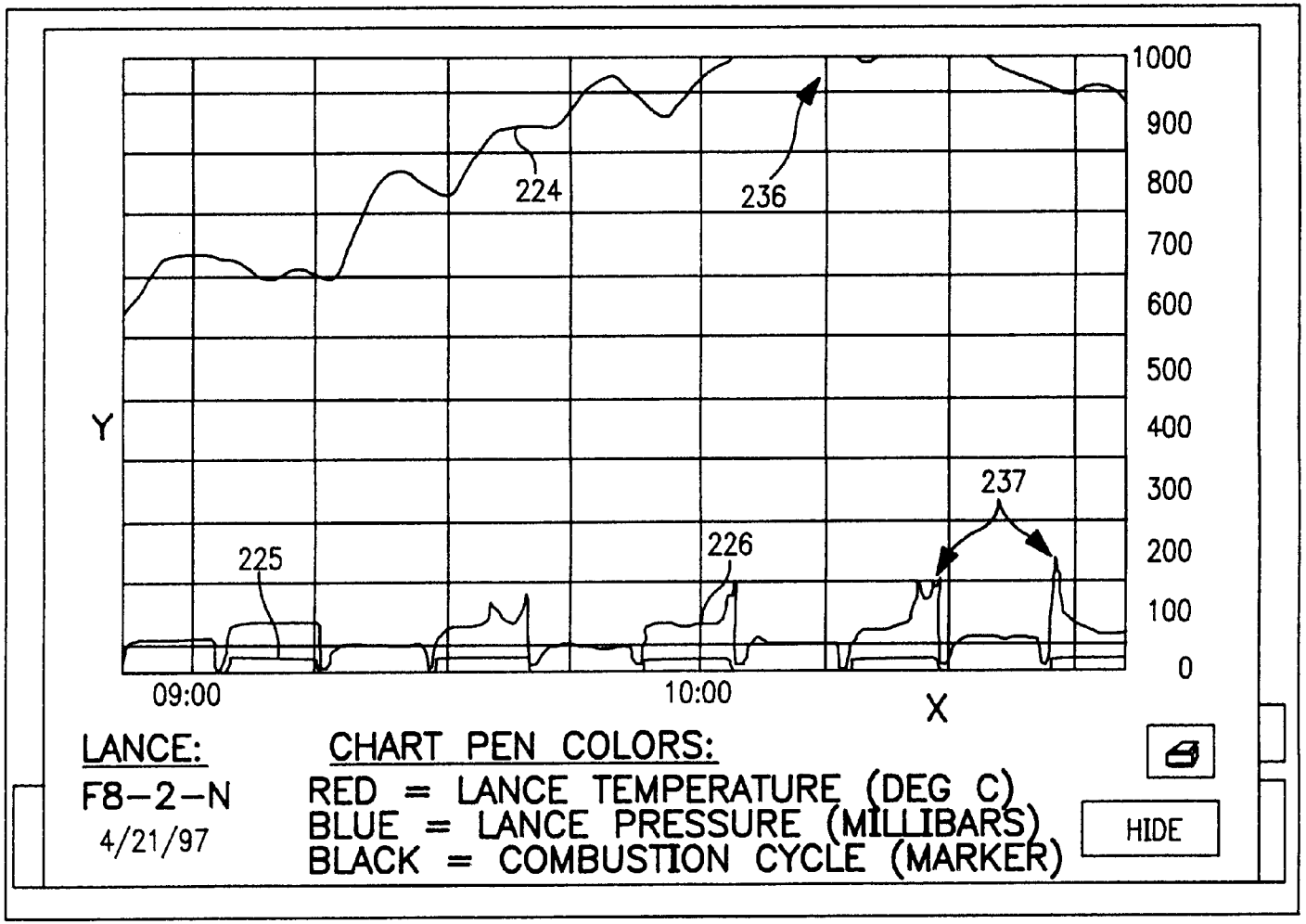
FIG. 13 is another computer display as in FIG. 11 but showing a lance having temperature and pressure above the desired range.

FIG. 13 shows a plot such as FIG. 11 wherein the temperature and pressure of a lance have exceeded the desired ranges, as at 236 and 237. It has been experienced that this condition typically results from an obstruction at the lance tip which plugs the tip, with the plugged condition being particularly identifiable by the pressure spikes as shown at reference numeral 237. It has been experienced that lance conditions as represented by this plot and condition may also be alleviated in many cases by the same fuel reduction/shut-off procedure described in connection with FIG. 12.

For the purpose of further example, it has also been observed that a normal lance temperature with a high pressure is indicative of at least a partial blockage of the fuel line as caused by formation of coke on the interior of the fuel line. This typically must be treated by mechanically removing the blockage as by use of an auger. Conversely, a high temperature and normal pressure is indicative of uneven stone movement which is generally treatable by decreasing flow to the affected lances as described previously. Thus, monitoring both lance temperature and pressure in accordance with the invention is useful to enable more accurate diagnosis of the source of the problem.

Monitoring of the kiln in accordance with the invention has also been observed to be useful to detect problems during the start-up phase of the kiln such as an unsuitable fuel mix or an excess of oxygen in the fuel lines, both of which result in excessive lance temperatures or pressures or both and if not quickly detected may result in damage to the lances.

As will be appreciated, the present invention enables improved control over kiln operation and enables operators to quickly spot problems which left undetected would likely result in damage to the kiln and poor product quality. In addition, the kiln and method for operating enable the use of cheaper fuels which in the past have been troublesome and undesirable because of the operating problems encountered during their use.

The foregoing description of certain embodiments of the present invention has been provided for purposes of illustration only, and it is understood that numerous modifications or alterations may be made without departing from the spirit and scope of the invention as defined in the following claims.

What is claimed is:

1. A regenerative shaft kiln, comprising:

at least two vertical shafts, each shaft having a pre-heating zone in communication with a source of aggregate for introducing aggregate into the kiln, a fuel introduction zone below the pre-heating zone and including a plurality of lances in communication with a source of fuel for introducing fuel into the kiln, a combustion zone below the fuel introduction zone, a cooling zone below the combustion zone, and a crossover zone between the combustion zone and the cooling zone, the crossover zone of each of the shafts being in flow communication with the crossover zone of at least one other shaft;

sensors proximate a plurality of the lances, said sensors comprising a plurality of temperature sensor assemblies, each temperature sensor assembly operatively associated with one of the lances and configured to enable monitoring of the temperature at a tip portion of the lance and producing a first temperature output signal having a magnitude corresponding to the temperature at the tip portion of the lance, and a plurality of pressure sensor assemblies, each pressure sensor assembly operatively associated with an interior portion of one of the lances and configured to enable monitoring of the pressure of the interior portion of the lance and producing a first pressure output signal having a magnitude corresponding to the pressure within the interior portion of the lance; and a comparator in communication with each of the sensors for receiving the first output signals of the sensors for comparing the magnitude of each first output signal with a predetermined control magnitude and producing a second output signal when the magnitude of one of the first output signals exceeds the control magnitude, the second output signals being coded to identify each sensor corresponding to each first output signal which produces a second output signal.

2. The kiln of claim 1, further comprising:

fuel supply means operatively associated with each lance and the source of fuel for controlling the travel of fuel through each lance; and fuel control means operatively associated with the comparator and the fuel supply means for ceasing the travel of fuel through one or more of the lances in response to one or more second output signals.

3. The kiln of claim 1, further comprising a display responsive to the second output signals for indicating the identity of one or more sensors that produced the second output signals.

4. The kiln of claim 3, wherein the display comprises indicia representative of all of the lances.

5. The kiln of claim 3, wherein the display includes a plurality of icons, each icon representing one of the lances and including information corresponding to the magnitude of the first output signals.

6. A regenerative shaft kiln, comprising:

at least two vertical shafts, each shaft having a pre-heating zone in communication with a source of aggregate for introducing aggregate into the kiln, a fuel introduction zone below the pre-heating zone and including a plurality of lances in communication with a source of fuel for introducing fuel into the kiln, a combustion zone below the fuel introduction zone, a cooling zone below the combustion zone, and a crossover zone between the combustion zone and the cooling zone, the crossover zone of each of the shafts being in flow communication with the crossover zone of at least one other shaft;

sensors proximate a plurality of the lances, said sensors comprising a plurality of temperature sensor assemblies, each temperature sensor assembly being operatively associated with one of the lances and configured to enable monitoring of the temperature at a tip portion of the lance and producing a first temperature output signal having a magnitude corresponding to the temperature of the tip portion of the lance, and a plurality of pressure sensor assemblies, each pressure sensor assembly operatively associated with an interior portion of one of the lances and configured to enable monitoring of the pressure of the interior portion of the lance and producing a first pressure output signal having a magnitude corresponding to the pressure within the interior portion of the lance.

a comparator in communication with each of the sensors for receiving the first output signals of the sensors, comparing the magnitude of each first output signal with a predetermined control magnitude and producing a second output signal when the magnitude of one of the first output signals exceeds the control magnitude, the second output signals being coded to identify each sensor corresponding to each first output signal which produces a second output signal; and a display for displaying the second output signals and the magnitude of the first output signals.

7. The kiln of claim 6, wherein the display provides a display of the magnitude of the first output signals versus time.

8. The kiln of claim 6, further alarm means operatively responsive to the second output signals.

* * * * *

UNITED STATES PATENT AND TRADEMARK OFFICE
CERTIFICATE OF CORRECTION

Patent No : 6,113,387

Dated : September 5, 2000

Inventor(s) : WILSON et al.

It is certified that error appears in the above-identified patent and that said Letters Patent are hereby corrected as shown below:

Column 2, line 65, "latices" should be --lances--, and

Column 5, line 40, "coot" should be --cool--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*